US006193589B1

(12) United States Patent
Khalaj

(10) Patent No.: US 6,193,589 B1
(45) Date of Patent: Feb. 27, 2001

(54) HAND PIECE APPARATUS FOR ABRASIVE CLEANING DEVICES

(76) Inventor: Ben M. Khalaj, 4 Autry, Irvine, CA (US) 92618

( * ) Notice: Subject to any disclaimer, the term of this patent is extended or adjusted under 35 U.S.C. 154(b) by 0 days.

(21) Appl. No.: 09/336,581

(22) Filed: Jun. 21, 1999

(51) Int. Cl.[7] ..... B24C 5/04
(52) U.S. Cl. ..... 451/102; 451/90; 451/87
(58) Field of Search ..... 451/102, 90, 87, 451/88, 78

(56) References Cited

U.S. PATENT DOCUMENTS

| | | | | |
|---|---|---|---|---|
| 4,333,277 | * | 6/1982 | Tasedan | 451/90 |
| 5,037,432 | * | 8/1991 | Molinari | 451/87 |
| 5,100,412 | * | 3/1992 | Rosso | 451/87 |
| 5,971,999 | * | 10/1999 | Naldoni | 451/87 |

* cited by examiner

*Primary Examiner*—Robert A. Rose

(57) ABSTRACT

An improved hand piece apparatus for use with abrasive cleaning devices uses a control switch that can be controlled manually by an operator to controllably regulate the amount a mixture of a pressurized air with abrasive particles at the nozzle head inlet port of the nozzle head assembly.

8 Claims, 6 Drawing Sheets

HAND PIECE APPARATUS FOR ABRASIVE CLEANING DEVICES

FIELD OF THE INVENTION

The present invention relates to a hand piece apparatus that can be used in cleaning devices in order to remove and capture dirt and debris from a surface by using abrasive particles with mixture of high pressurized air and vacuum. More particularly, the invention relates to a hand piece that can controllably regulate the amount of the pressure applied to a surface and the pressurized abrasive particles in hand piece can also be limited from circulation or can be blocked completely at the hand piece's nozzle head assembly for safe operational use.

BACKGROUND OF THE INVENTION

Abrasive cleaning devices are well known as surfacing applicators to treat surfaces for cleaning, smoothing, etching and resurfacing a damaged area such as human skin. These devices operate on a high stream of a pressurized air or vacuum suction to carry abrasive particles to be impinged against the surface. The high pressure of abrasive particles removes dirt and debris from a surface and provides an extremely satisfactory cleaning means. However, considerable risks are involved with such pressurized abrasive cleaning operations. Many of the cleaning operations such as resurfacing human skin are performed near or on the face area. The pressurized abrasive particles along with its dust form particles may cause hazardous health risk to the patient and the operator. Therefore, it is necessary for the operator to visually monitor and control the amount of pressure applied to a surface with a controllable hand piece that can conveniently function at the operator's command.

SUMMARY OF THE INVENTION

It is an object of the present invention to provide an improved hand piece apparatus for use with abrasive cleaning devices. This hand piece uses a control switch that can controllably regulate the amount of pressure applied on a surface. The control switch preferably is a dial switch and located inside the nozzle head assembly of the hand piece and easily accessible by an operator.

It is another object of this invention to enable the operator to use the control dial switch to limit or block the stream of the pressurized abrasive particles. This control switch conveniently provides three positions: full-flow pressure, low-flow pressure and shut-off or block position.

It is still another object of this invention to use a handle that is ergonomically designed for ease of operational use and conveniently enable the operator to access the control switch thereof.

It is also another object of the present invention to connect the nozzle head assembly inlet port and outlet port to a pair of vacuum tubes in order to reduce the residue of the hand piece material on a treating surface. The preference of this invention is to eliminate any lumens in the handle for purpose of high pressure passages.

These objects are attained by using a hand piece that comprises a housing assembly, a nozzle head assembly and a pair of vacuum tubes. The hand piece's housing assembly also includes a nosepiece with a protruded frontal hole for purpose of contacting the debris surfaces, a handle consist of two half members with flat sides and rounded on the top and bottom, and an end piece with an opening for passage of vacuum tubes. The housing assembly of the hand piece further accommodates the nozzle head assembly, which is preferably secured at the nosepiece and the handle. A pair of vacuum tubes from the vacuum source and control unit are connected to the inlet port and outlet port of the nozzle head assembly. The inlet port having a conical opening at the proximal end and an orifice at the distal end for ejecting a mixture of high pressurized air with stream of abrasive particles onto a surface. However, the outlet port of the nozzle head assembly retrieves the abrasive particles along with debris particles from the surface by means of vacuum suction. A control dial switch is placed inside of the nozzle head assembly to manipulate and restrict the applied pressure as enters into the inlet port of the nozzle head assembly. An operator can easily rotate the dial switch in direction of clockwise or counter-clockwise, to control the amount of abrasive particles or simply shut off the flow of abrasive particles in the nozzle head assembly.

Further objects and advantages of this invention will become apparent from consideration of the drawings and description that follows.

BRIEF DESCRIPTION OF THE DRAWINGS

Exemplary embodiments of the invention will now be described in conjunction with the drawings in which.

DETAILED DESCRIPTION OF THE INVENTION

Figure 1:
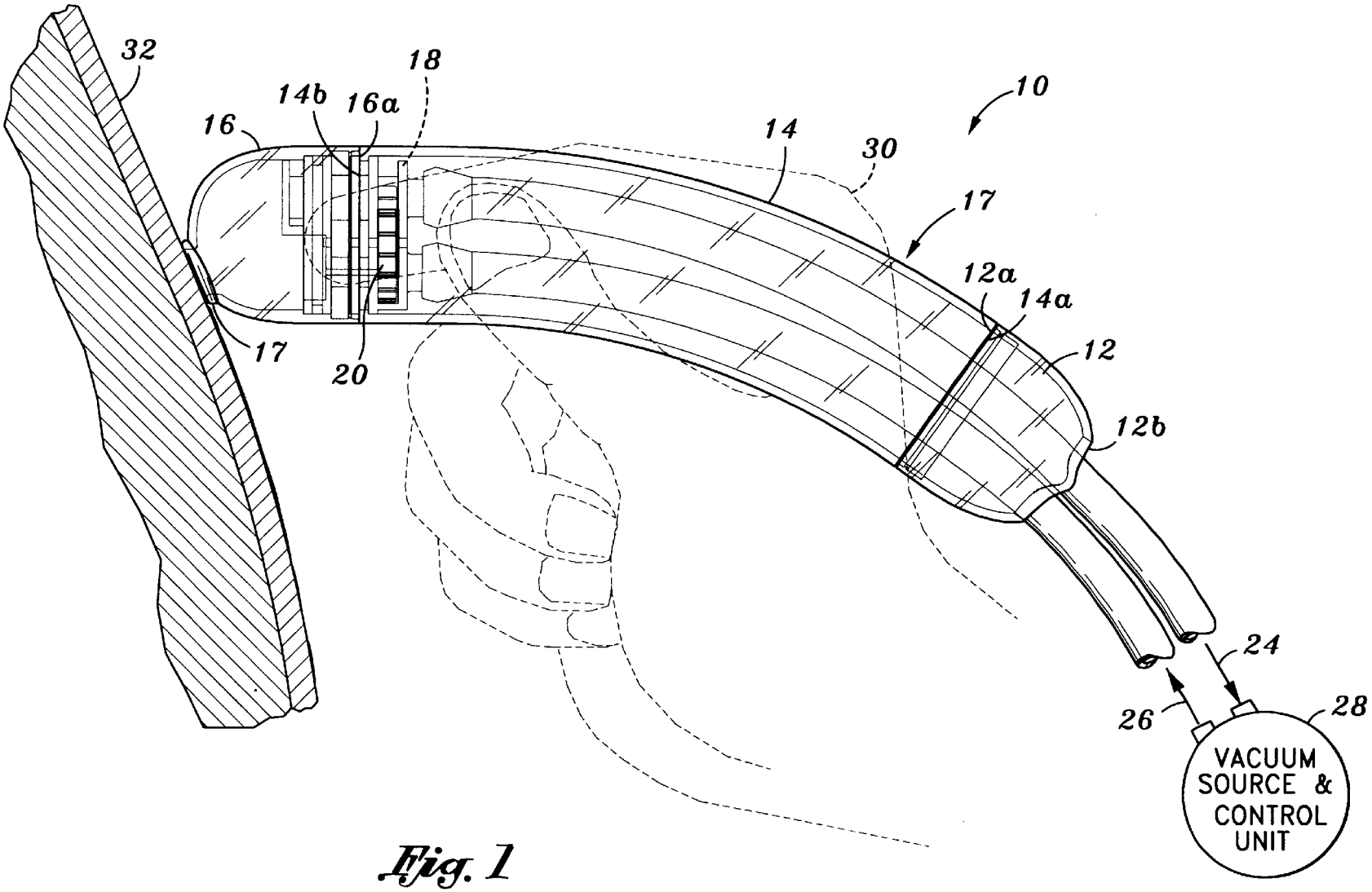
FIG. 1 is a side view of the present invention showing a hand piece in conjunction with a vacuum source and control unit.

FIG. 1 is showing a side view of a hand piece 10 accordance with the present invention for use in abrasive cleaning devices. The hand piece 10 comprises a housing assembly 11, a nozzle head assembly 18 and a pair of vacuum tubes 24, 26. The housing assembly 11 of the hand piece 10 further includes a nosepiece 16, a handle 14, and end piece 12. The nosepiece 16 having a protruded opening 17 for contacting a surface such as human skin 32 and at its distal end 16*a* connected to the proximal end of a handle 14*b*. The distal end of the handle 14*a* is also connected to the proximal end of the end piece 12*a*. The handle 14 also formed in a curvature or bend shape to provide an ergonomic way of using the hand piece 10 and ultimately provide the ease of the operational use to an operator's hand 30.

Figure 2:
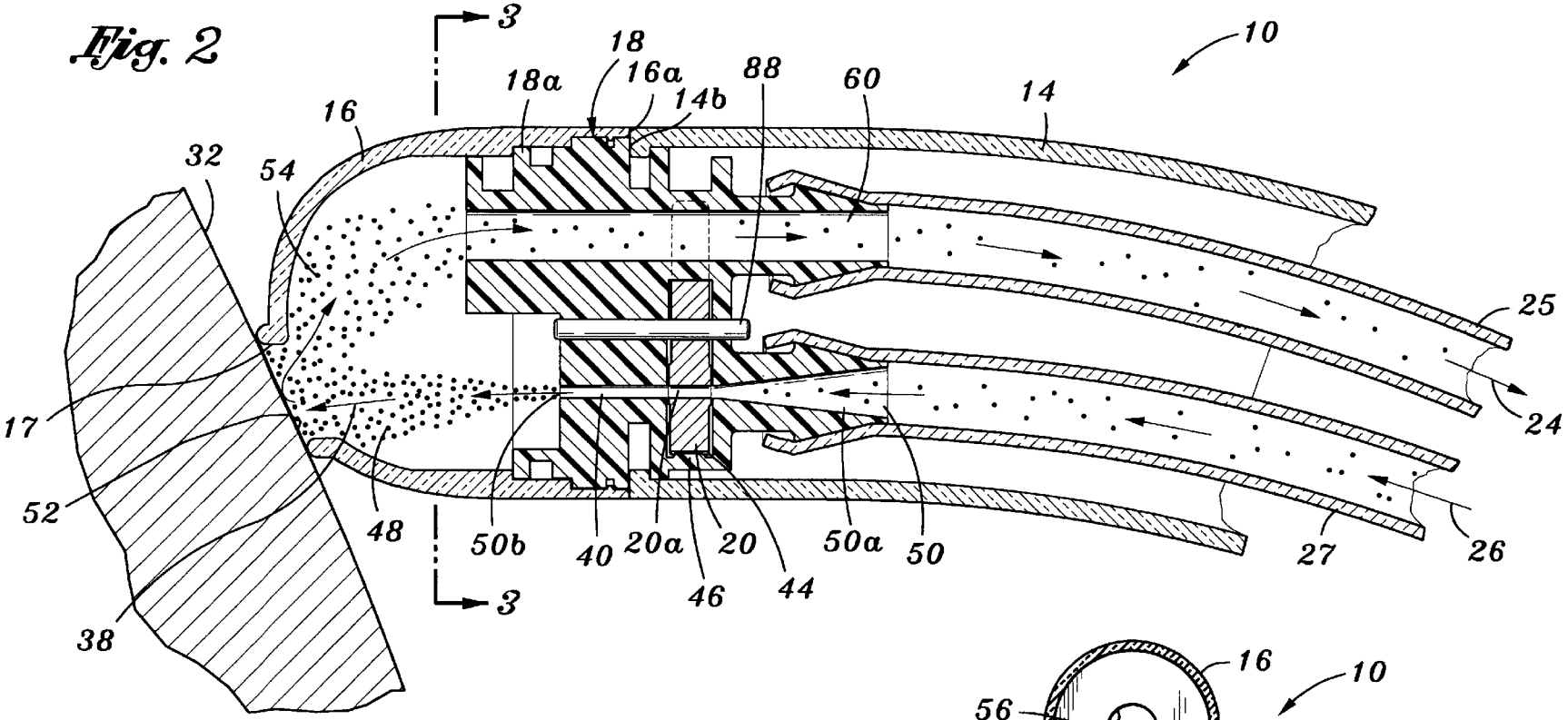
FIG. 2 is a partial cross sectional view of the tip portion of the hand piece shown against a surface.
Figure 3:
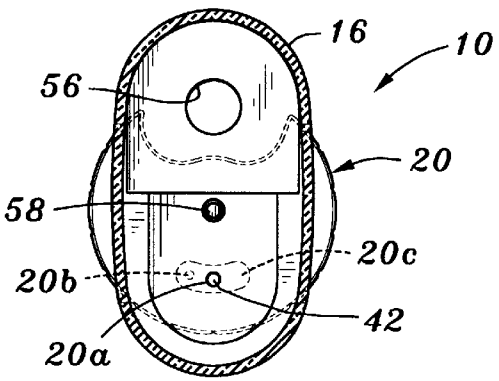
FIG. 3 is a cross sectional view taken along line 3—3 in FIG. 2.

Referring to FIG. 1 and FIG. 2, the nozzle head assembly 18 is secured within the housing assembly and located between the nosepiece 16 and handle 14. The nozzle head assembly 18 includes a main body 18*a* with inlet port 50 and outlet port 60, and a control dial switch 20.

Figure 4:
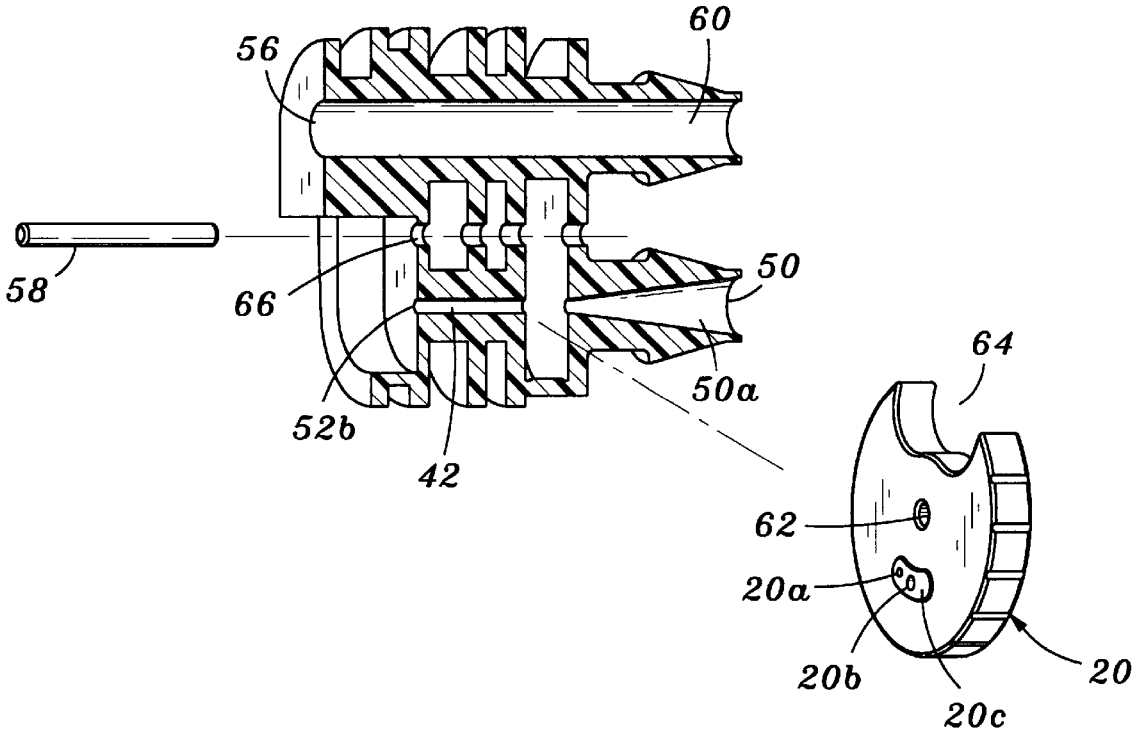
FIG. 4 is an exploded view of the nozzle head assembly.

A vacuum source 28 provides a high pressurized air with mixture of abrasive particles 26 and passing it through a vacuum tube 27. Then the pressure enters the inlet port 50 of the nozzle head assembly 18. The conical opening 50*a* of the inlet port 50 direct the pressure into the controllable dial switch 20 and then passes it into a smaller bore known as a nozzle port 40. The pressurized abrasive particles 26 eject from the nozzle orifice 52*b* with a high velocity and strike against a surface 52 to remove and release the debris particles from a surface 52. The applied pressure 38 on the surface 52 can also be manipulated with dial switch 20 to provide various velocities and desire pressure to strike the surface 52. The control dial switch 20 pivotally connected 58 to the central hole 66 of a main body 18*a* of the nozzle head assembly 18 and rotates in direction of clockwise or counter-clockwise to provide various pressure settings as best shown in FIG. 4. Furthermore, the dial switch includes two various nozzle ports 20*a,* 20*b* and a blockage wall 20*c* to restrict the flow as needed by an operator.

After striking the particles onto a surface 52, a vacuum suction retrieves the particles 54 and directs them into the suction vacuum port 56 of the nozzle head assembly 18 and ultimalty exited from the outlet port 60. The particles return to a vacuum source and a control unit 28 to be filtered and to be used again in the recycling process.

FIGS. 2–3 and FIGS. 5–8 showing a different position of the dial switch 20 with respect to pressurized abrasive particles 26 and the function of a hand piece 10.

Figure 5:
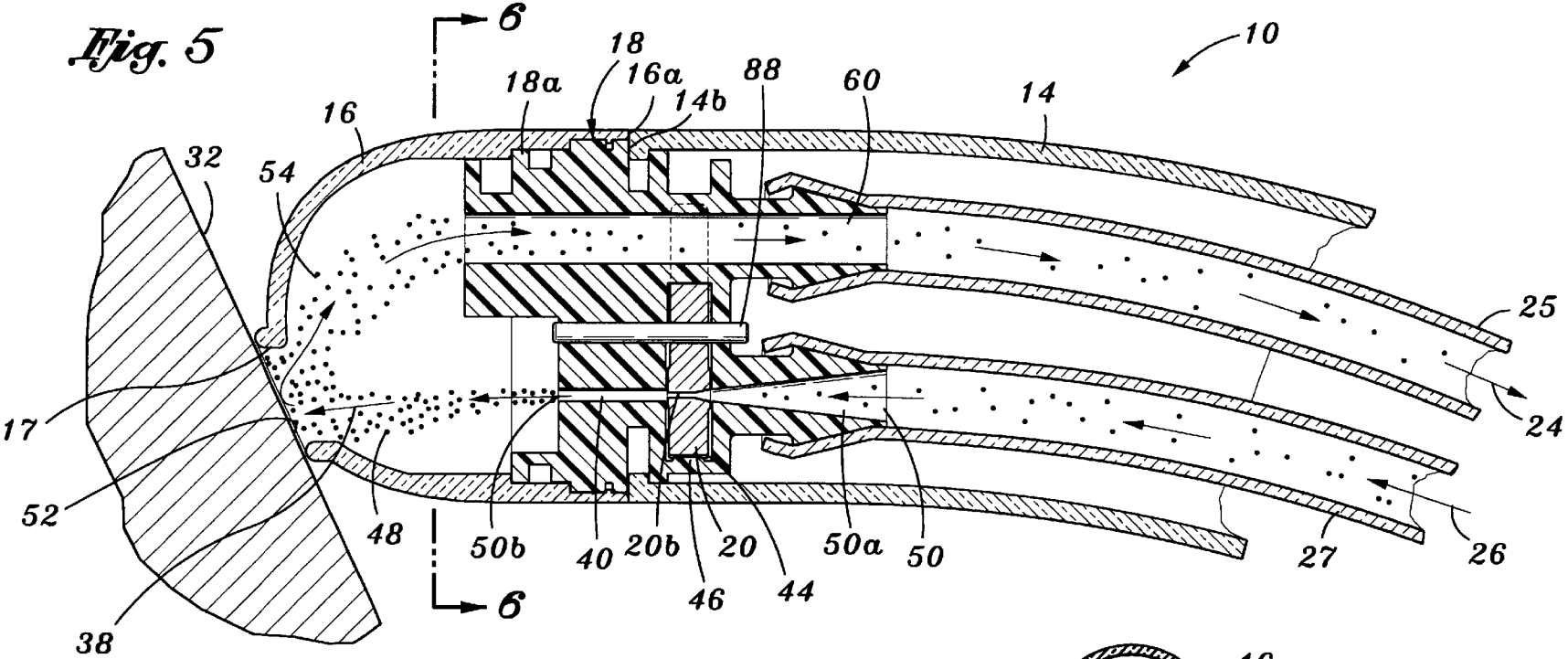
FIG. 5 is a similar view to FIG. 2, except the control dial switch shown in reduced or low- pressure position.
Figure 6:
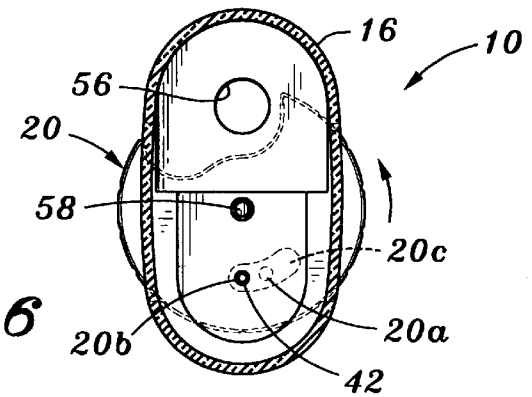
FIG. 6 is a cross sectional view taken along line 6—6 in FIG. 5.

In FIGS. 5–6, the dial setting is set for a smaller nozzle port 20*b* to provide a smaller amount of pressurized abrasive particles to a surface.

Figure 7:
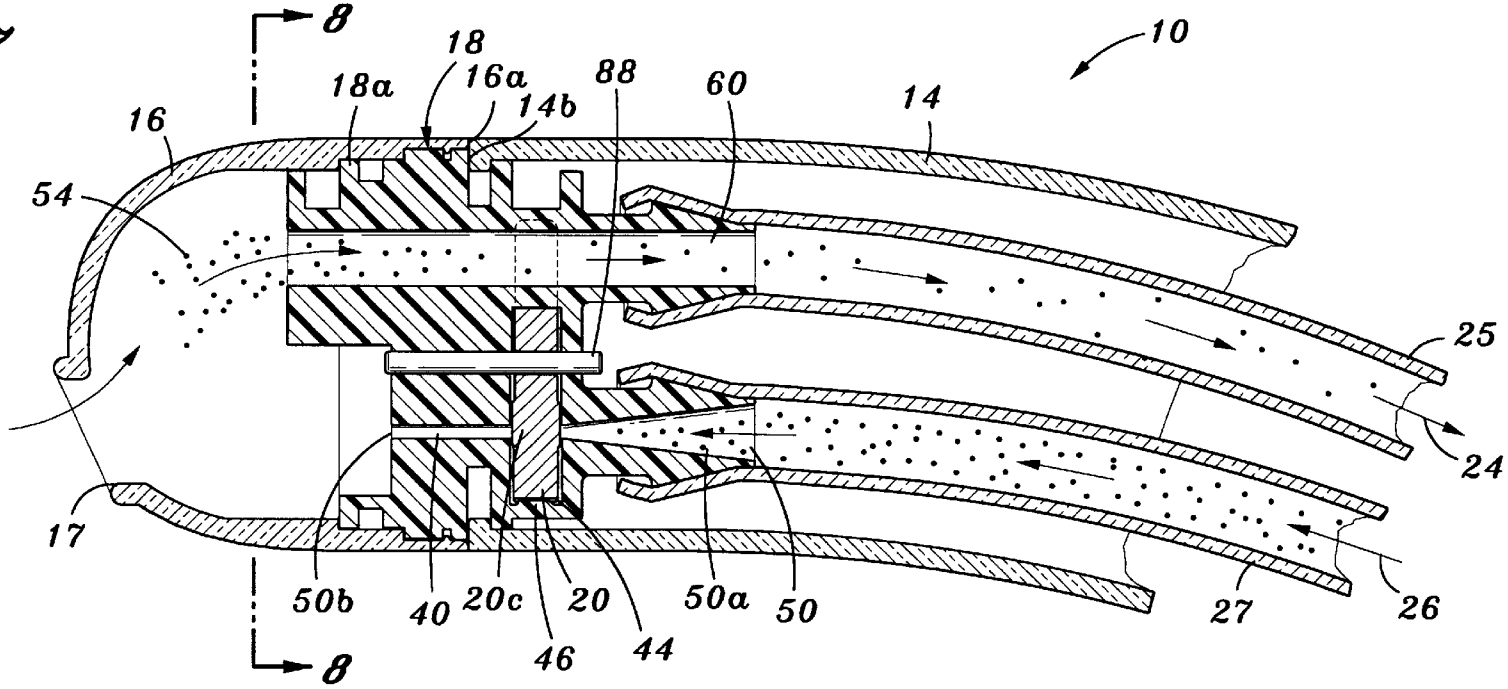
FIG. 7 is a similar view to FIG. 2, except the control dial switch shown in block or shut off position.
Figure 8:
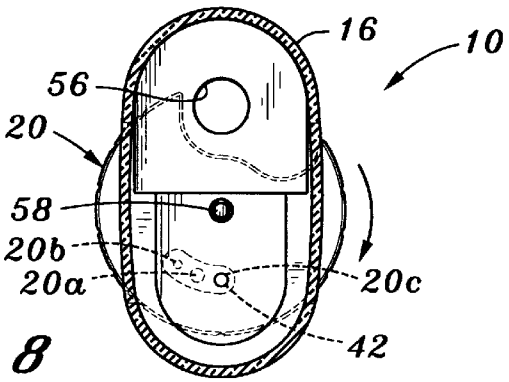
FIG. 8 is a cross sectional view taken along line 8—8 in FIG. 7.

In FIGS. 7–8, the dial setting is set for a block wall 20*c* to block the pressurized abrasive particles from circulation.

Figure 9:
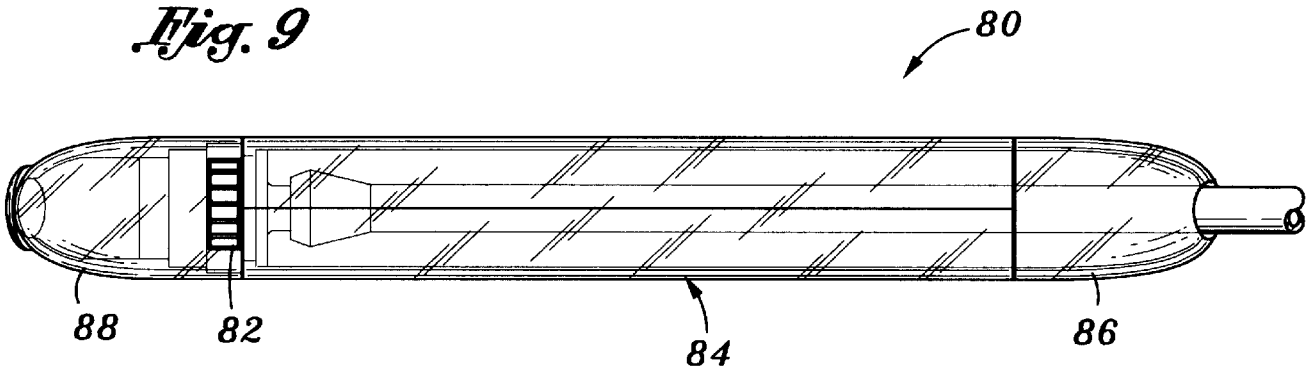
FIG. 9 is an alternative embodiment of the present invention showing the top view of a hand piece and its dial switch located on the top of the device.
Figure 11:
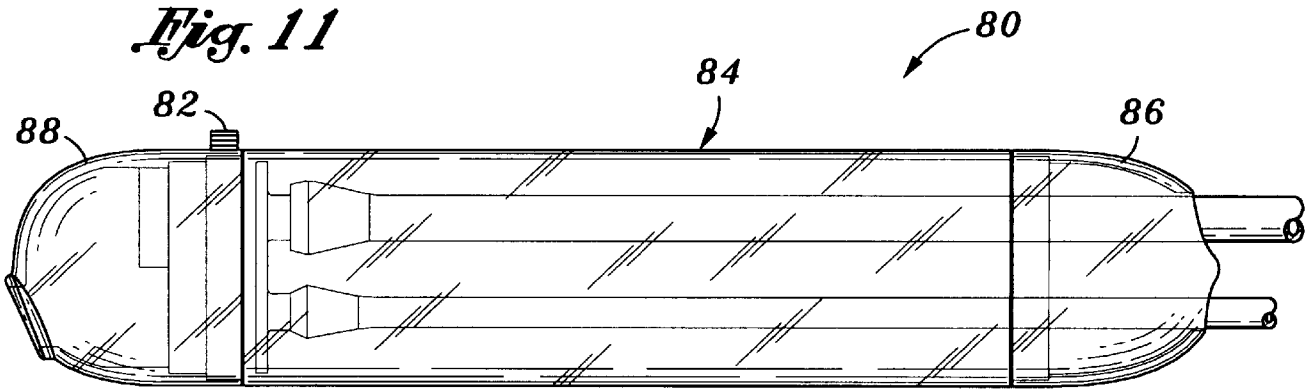
FIG. 11 is a side elevation thereof.
Figure 10:
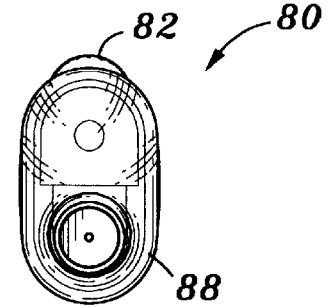
FIG. 10 is a frontal view thereof.

FIGS. 9–11 is shown the alternative embodiment of the hand piece 80 with straight handle 84, a nosepiece 88 and end piece 86. The control switch 82 is located on the top of the hand piece 80.

While this invention is susceptible of embodiments in many different forms, this specification and the accompanying drawings disclose only some specific forms as examples of the invention. The invention is not intended to be limited to the embodiments so described, however, the scope of the invention is pointed out in the appended claims.

I claim:

1. An improved hand piece apparatus for use with abrasive cleaning devices comprising:

a housing assembly, said housing assembly includes a nosepiece with a protruded frontal opening for purpose of contacting a surface, a handle which connected at one end to the distal end of said nosepiece and at the other end connected to the proximal end of an end piece;

a nozzle head assembly, said nozzle head assembly is secured between the said nosepiece and said handle, said nozzle head assembly includes a main body with an inlet port and an outlet port, said inlet port having a conical opening at the proximal end and an orifice at the distal end, said main body pivotally accommodates a switch that can manually be controlled by an operator to control said inlet port pressure at the proximal end and also at distal end of said inlet port; and, a pair of tubes, one said tube is connected to said inlet port of said nozzle head assembly for delivery of pressurized air and abrasive to said nozzle head assembly and the other said tube is connected to said outlet port of said nozzle head assembly to provide vacuum pressure to said nozzle head assembly.

2. A hand piece according to claim 1, wherein said housing assembly is made of a transparent material.

3. A hand piece according to claim 1, wherein said handle consist of two half members, said members having flat sides with rounded top and rounded bottom.

4. A hand piece according to claim 1, wherein said handle formed in curvature shape for ease of operational use.

5. A hand piece according to claim 1, wherein said switch having at least one nozzle port to control the said inlet port pressure of said nozzle head assembly.

6. A hand piece according to claim 1, wherein said switch having at least one blockage wall to restrict the flow of pressure in said inlet port nozzle.

7. A hand piece according to claim 1, wherein said switch is a dial switch.

8. A hand piece according to claim 1, wherein said switch is accessible on the said housing assembly.

* * * * *